US008079877B1

(12) United States Patent
Lai et al.

(10) Patent No.: US 8,079,877 B1
(45) Date of Patent: Dec. 20, 2011

(54) POWER ADAPTER CONNECTING IN A SURFACE TO SURFACE CONTACT

(75) Inventors: Chyi-Lang Lai, New Taipei (TW); Yen-Chih Chen, New Taipei (TW)

(73) Assignee: Chicony Power Technology Co., Ltd., Taipei (TW)

( * ) Notice: Subject to any disclaimer, the term of this patent is extended or adjusted under 35 U.S.C. 154(b) by 0 days.

(21) Appl. No.: 13/044,693

(22) Filed: Mar. 10, 2011

(51) Int. Cl.
*H01R 25/00* (2006.01)

(52) U.S. Cl. ..... 439/655; 439/172

(58) Field of Classification Search ..... 439/655, 439/640, 172, 131
See application file for complete search history.

(56) References Cited

U.S. PATENT DOCUMENTS 5,775,921 A * 7/1998 Chou ..... 439/21
6,089,921 A * 7/2000 Chou ..... 439/640
7,168,969 B1 * 1/2007 Wang ..... 439/173
7,255,568 B1 * 8/2007 Wu ..... 439/23
7,381,059 B2 * 6/2008 Wong ..... 439/22
7,462,074 B1 * 12/2008 Devlin et al. ..... 439/640
7,575,436 B1 * 8/2009 Devlin et al. ..... 439/21
7,946,868 B1 * 5/2011 Chen ..... 439/173
2005/0226476 A1 * 10/2005 Funahashi et al. ..... 382/124
* cited by examiner

*Primary Examiner* — Tulsidas C Patel
*Assistant Examiner* — Travis Chambers
(74) *Attorney, Agent, or Firm* — Chun-Ming Shih; HDLS IPR Services

(57) ABSTRACT

A power adapter capable of connecting a plug with an electronic board of the power adapter includes an insulated body, a plug and two conductive terminals. The insulated body includes a switching section with a switching space. The plug includes a turntable and two conductive inserts penetrating the turntable. The turntable is positioned on the switching section. Two conductive inserts respectively include a plug pin. The two conductive terminals extend to respectively connect to the electronic board. Each conductive terminal is connected with the switching section and the surface of the conductive terminal is attached to the surface of the plug pin of the conductive insert. As a result, when changing the direction of the plug, the plug can have good electric connection with the conductive terminals.

11 Claims, 8 Drawing Sheets

POWER ADAPTER CONNECTING IN A SURFACE TO SURFACE CONTACT

BACKGROUND

1. Technical Field

The present invention relates to a power adapter. More particularly, the present invention relates to a power adapter which can change the direction of the plug.

2. Related Art

When the electronic products are used, a power adapter can be usually used to provide electricity. However, an extra plug adapter is needed for reasons such as the limitation of the location, the difference of the shape of the plug and etc. and it is not convenient for usage. Therefore, ones in the related art have developed a power adapter which can change the plug or the direction of the plug. The design permits the plug replaceably to connect to the body of the plug adapter. Different kinds of plugs can be connected to the body of the power adapter depends on the different needs.

The plug of the above-mentioned power adapter usually has two conductive inserts for inserting into the power outlet. In addition, inside of the body of the power adapter is provided with corresponding conductive terminals. When the plug is assembled to the body of the power adapter, two conductive inserts need to connect with the conductive terminals and in turn connect with inside components of the power adapter in order to provide the outside electricity to the electronic products.

In the power adapter mentioned above, the conductive terminals and the conductive inserts are connected in point contacts and the majority of the conductive inserts are exposed in the power adapter body. As a result, when turning the direction of the plug, the conductive terminals might be accidentally connected with each other, which may cause deformation and a bad electronic connection. This will also increase the resistance or cause the electric spark and therefore affect the transmission efficiency and create power loss.

BRIEF SUMMARY

The present application provides a power adapter with a good electronic connection by connecting pins of the plug and the conductive terminal in a surface to surface contact. In addition, because the conductive terminal is exposed a little bit, it can prevent users from touching or destroying the terminals.

The present application further provides a power adapter capable of changing the plug or the direction of the plug.

A power adapter of the present application is a power adaptor capable of connecting a plug with an electronic board of the power adapter. The power adapter comprises an insulated body, a plug and two conductive terminals. The insulated body includes a switching section to form a switching space connected to the outside space. The plug includes a turntable and two conductive inserts penetrating the turntable. The turntable is positioned on the switching section. Two conductive inserts respectively include a plug pin. The two conductive terminals extend and respectively connect to the electronic board. Each conductive terminal is connected with the switching section and is attached to the plug pin of the conductive insert in a surface to surface contact.

The present application further comprises a power adapter, which includes a dust-proof film inside of the insulated body. The dust-proof film corresponds to the switching space to prevent outside dust or water from entering the installation space of the insulated body to maintain a good electronic connection.

The present application further provides a power adapter, wherein the aperture of the dust-proof film is provided with a blocking piece on its side to avoid the creation of the electric spark near the aperture and therefore to increase the safety of the usage.

Compared to the related art, the conductive terminals of the power adapter comprises two conductive arms. The conductive piece of the conductive arms attach to the plug pins of the conductive inserts in a surface to surface contact to let two conductive inserts respectively connected with the conductive terminals in surface contact and therefore achieves a good electric connection. In addition, the conductive terminals of the present invention protrude partially from the positioning ring to be connected with the conductive inserts of the plug. Because the terminals are exposed a little bit, it can prevent users from touching or destroying the terminals. The conductive terminals are also connected with the terminal pieces to have better support force. Moreover, the insulated body of the present invention includes a dust-proof film corresponding to the switching space in order to prevent outside dust or water from entering the insulated body through switching space. The dust-proof film may also include a blocking piece on the side of the aperture to avoid the creation of the electric spark near the aperture (grounding pin) and therefore to increase the safety of the usage.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
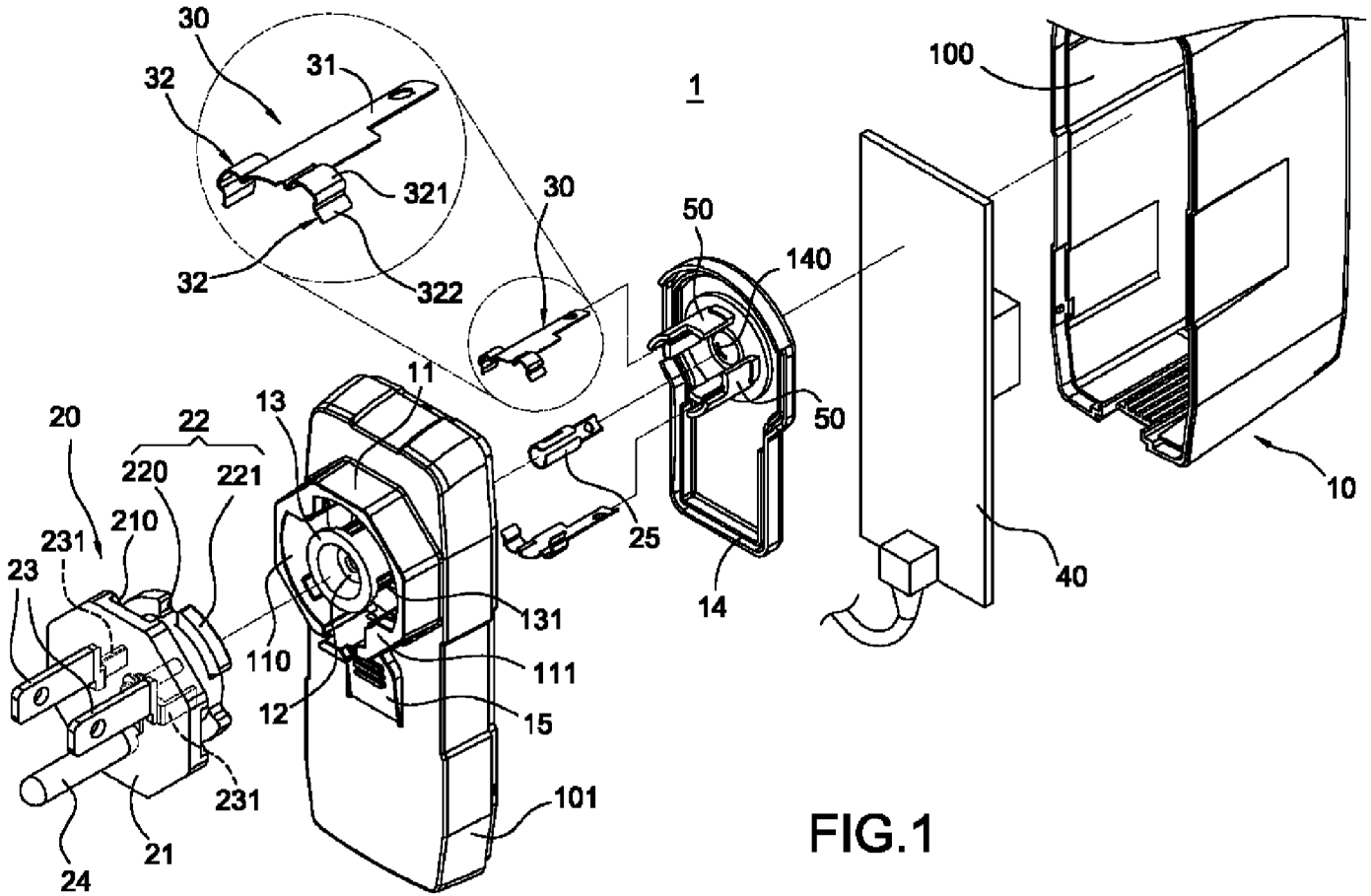
FIG. 1 is an exploded view of one embodiment of the power adapter of the present invention.
Figure 2:
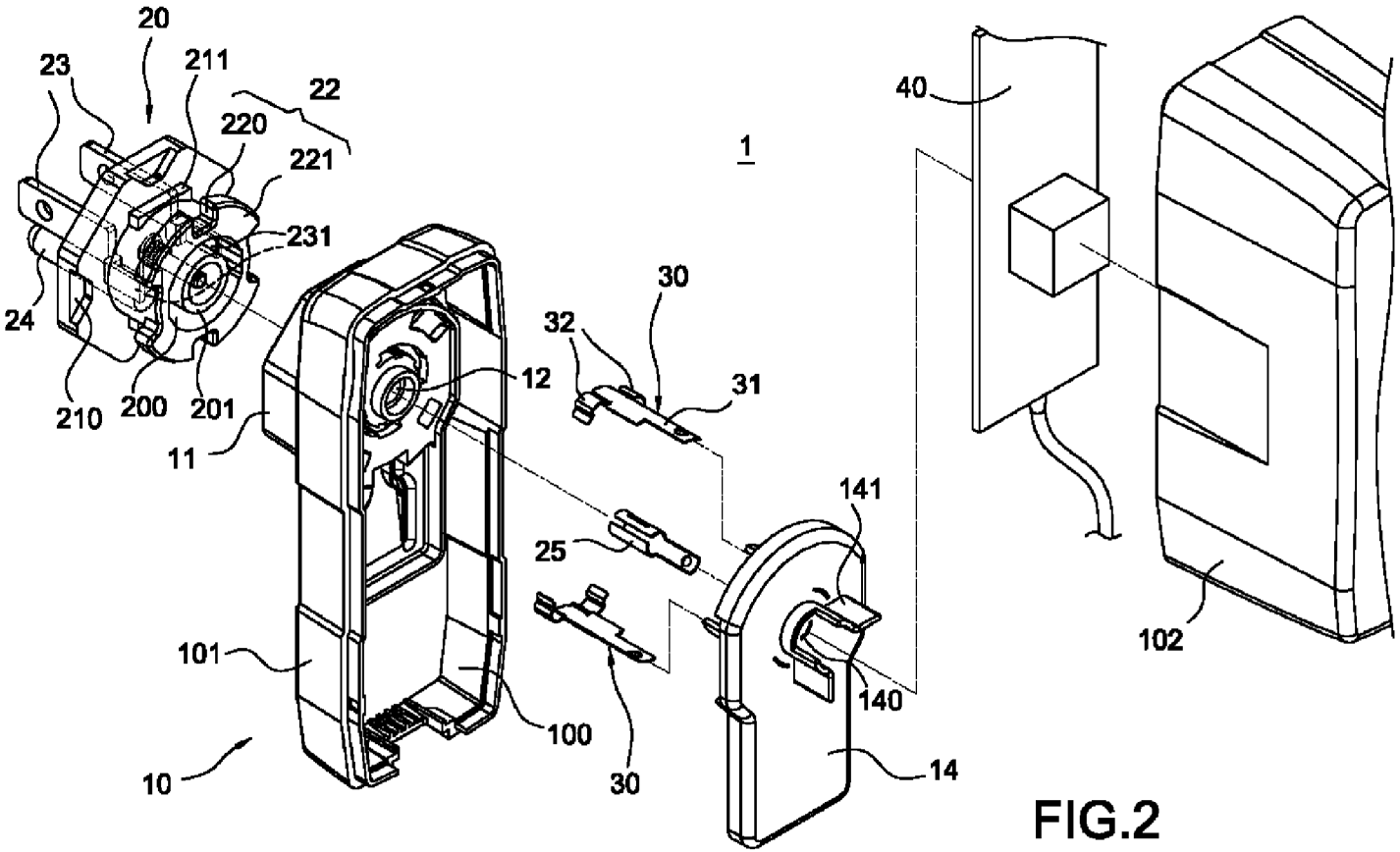
FIG. 2 is an exploded view of one embodiment of the power adapter of the present invention.
Figure 3:
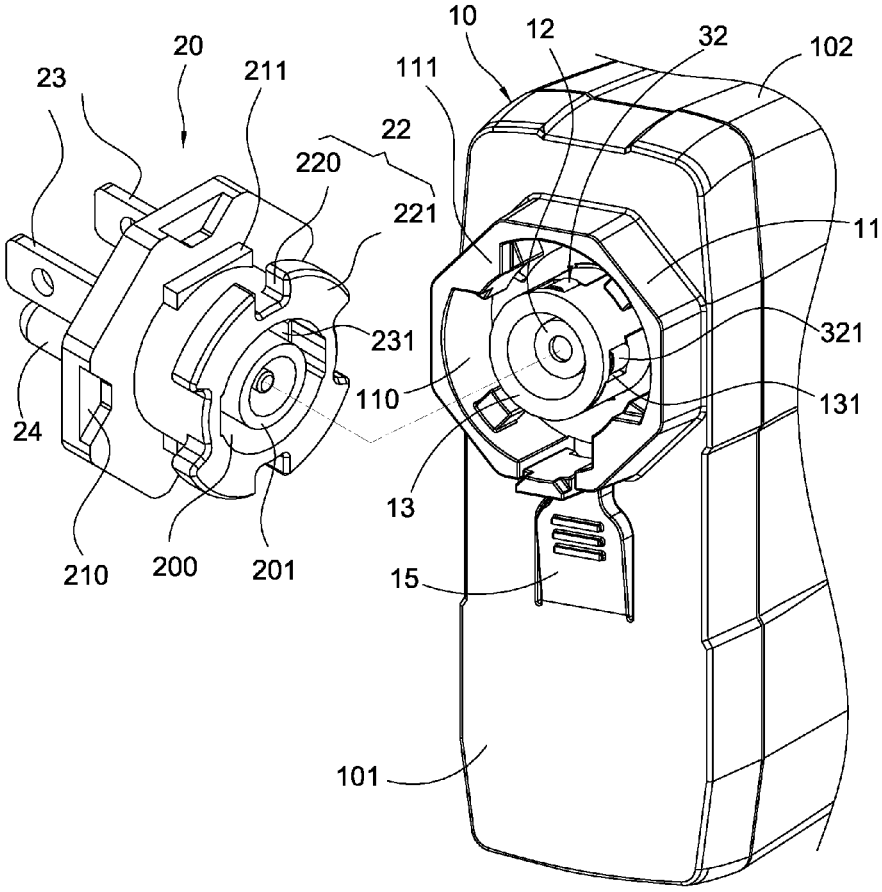
FIG. 3 is a schematic illustration of the installation of the plug of the present invention.
Figure 4:
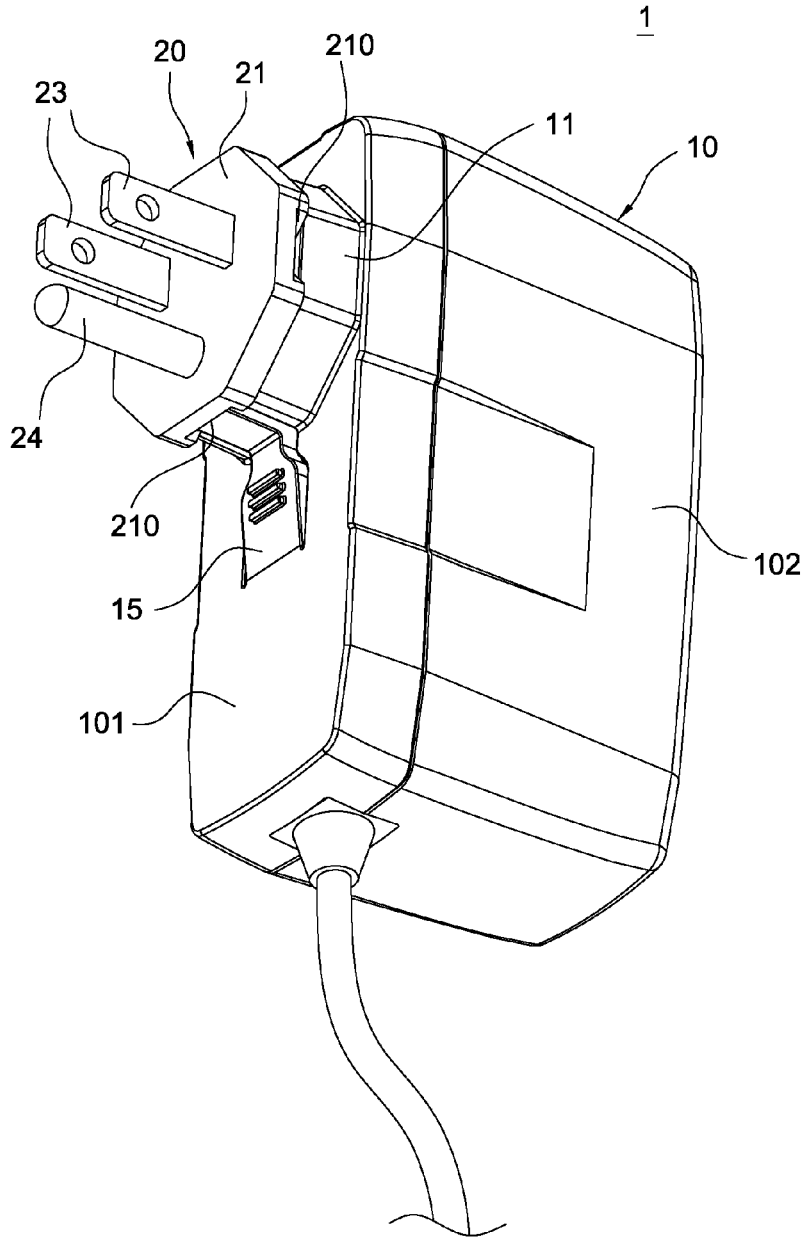
FIG. 4 is a schematic illustration of a perspective view of the appearance of one embodiment of the power adapter of the present invention after installation.

Hereinafter, the present invention will be described in detail with reference to the accompanying drawings. It should be understood that drawings do not limit the scope of the present invention.

Please refer to FIG. 1 to FIG. 5, which are respectively an exploded view of one embodiment of the power adapter of the present invention; an exploded view of one embodiment of the power adapter of the present invention; a schematic illustration of the installation of the plug of the present invention; a schematic illustration of a perspective view of the appearance of one embodiment of the power adapter of the present invention after installation; and a perspective view of the combination of one embodiment of the power adapter of the present invention. The power adapter 1 of the present invention comprises an insulated body 10, a plug 20, two conductive terminals 30 and a circuit board 40.

The insulated body 10 may be, but not limited to, essentially rectangle. In this embodiment, the insulated body 10 may include a first shell 101 and second shell 102. The first shell 101 and second shell 102 of the insulated body 10 may be engaged with each other to form an installation space 100. The first shell 101 of the insulated body 10 may include a switching section 11. The switching section 11 may form a switching space 110 connected to the outside space. The switching space 110 may form a hollow column 12. The switching section 11 may be provided with a positioning ring 13 surrounding the hollow column 12. The outside wall of the positioning ring 13 may include a plurality of positioning groove 131. In addition, the insulated body 10 may further include a dust-proof film 14. The dust-proof film 14 may be provided corresponding to the switching space 110 and may be connected with the installation space 100. The dust-proof film 14 may further include an aperture 140 corresponding to the hollow column 12. The dust-proof film 14 may be provided with a blocking piece 141 configured to prevent the creation of the electric arc.

The power adapter 1 may further comprise two terminal pieces 50. In this embodiment, two terminal pieces 50 may be provided on the dust-proof film 14. Two terminal pieces 50 may be connected with two conductive terminals 30 to provide better support force for two conductive terminals 30.

The plug 20 may be electronically connected with the circuit board 40 of the power adapter 1 and may be selectively connected to switching section 11. The plug 20 may comprise a turntable 21, a valve plate 22 attached to the turntable 21, two conductive inserts 23 penetrating the turntable 21, a grounding pin 24, and a grounding pin sleeve 25 connected to the grounding pin 24. The grounding pin sleeve 25 may be secured to the hollow column 12 and may penetrate into the aperture 140 of the dust-proof film 14. Two conductive inserts 23 may extend to form respectively two plug pins 231. The valve plate 22 may include a plurality of flanges 221. Two adjacent flanges 221 may form a gap 220 in between. In addition, the plug 20 may include an inserting space 200, an open tubular column 201 inside of the inserting space 200, two plug pins 231 and a grounding pin 24 protruding in the inserting space 200. The grounding pin 24 may penetrate into the open tubular column 201. Furthermore, the plug 20 may include a fool-proof piece 211 between the turntable 21 and the valve plate 22. The switching section 11 may form a plurality of blockings 111 corresponding to the fool-proof piece 211. After the flanges 221 are engaged with the respective blockings 111, turn the turntable 2 a little bit, the fool-proof piece 211 may be blocked by one side of the blockings 111. Therefore, the fool-proof piece 211 is configured to ensure the correction of the installation. Moreover, the turntable 21 may include a plurality of notches 210. The insulated body 10 may include a positioning elastic arm 15. The positioning elastic arm 15 may selectively be secured to the notches 210 in order to secure turntable 21 to the switching section 11.

Each conductive terminal 30 may include a positioning section 31 and two conductive arms 32 horizontally extending from the positioning section 31. The positioning section 31 may extend to the switching space 110 from the bottom of the switching space 110, in turn may be engaged with the positioning groove 131 to be connected with the switching section 11. The surface of one of the conductive arms 32 may be attached to the surface of the plug pin 231 of the conductive inserts 23.

Figure 5:
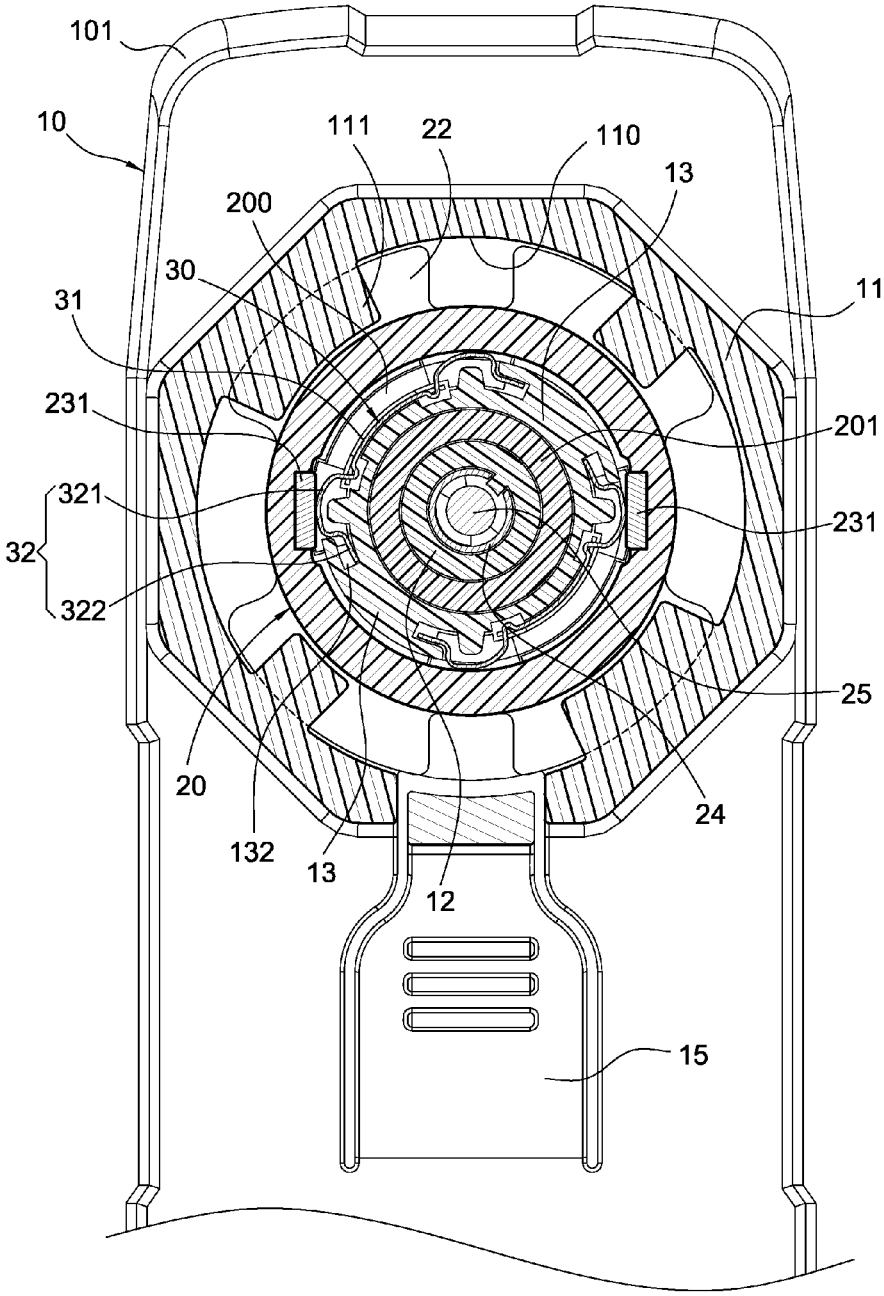
FIG. 5 is a perspective view of the combination of one embodiment of the power adapter.

As shown in FIG. 5, the positioning groove 131 outside the positioning ring 13 may respectively include a locking aperture 132 on each side. In addition, each of the conductive arms 32 of the conductive terminals 30 may include a protruding conductive piece 321, whose surface is attached to the surface of the plug pins 231. A locking piece 322 may be extended from the outside portion of the conductive piece 321. The locking piece 322 may be secured to the locking aperture 132. The conductive piece 321 may be convexly exposed from the positioning groove 131 and may be connected with the plug 20.

When the plug 20 is secured to the switching section 11 of the insulated body 10, the positioning ring 13 may be engaged in the inserting space 200 of the plug 20. As a result, the grounding pin 24 may be connected with the grounding pin sleeve 25. One of the two conductive arms 32 may attach to the plug pin 231 of the conductive inserts 23 in a surface to surface contact.

In this embodiment, the positioning section 31 of the conductive terminal 30 and two conductive arms 32 horizontally extending from the positioning section 31 may be one unity. The conductive arm 32 may, on both sides, respectively include a protruding conductive piece 321, whose surface is attached to the surface of the plug pin 231. The cross section of the conductive piece 321 may be a U shape and may have an arc surface. The opening of the arc surface of the conductive piece 321 may face away from the surface of the plug pin 231. The arc surface may be attached to the plug pin 231. When turning the plug to a particular angle, the arc surface may be attached to the surface of another conductive arm 32. Furthermore, each conductive arm 32 may extend from the first half portion of the positioning section 31. The conductive arm 32 may only expose its partial conductive piece 321 for connecting the plug pin 231. Because the conductive terminal is exposed a little bit, it may prevent users from accidentally touching or destroying the conductive terminal.

The circuit board 40 may be engaged in the installation space 100 of the insulated body 10. The positioning sections 31 of two conductive terminals 30 and the sleeve 25 penetrating into the aperture 140 of the dust-proof film 14 may be wielded respectively with the wire and connected electronically with the circuit board 40 by the wire.

Figure 6:
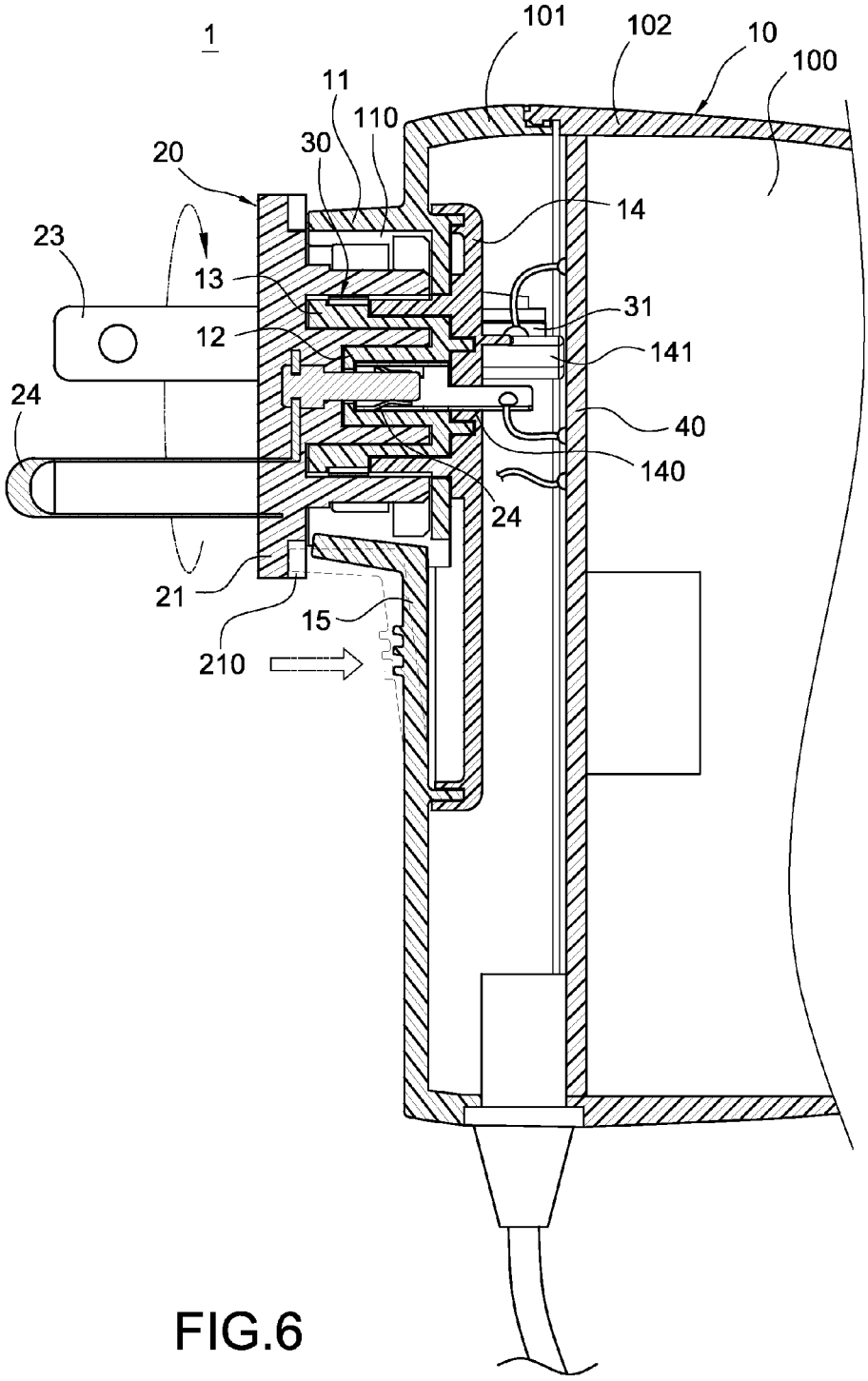
FIG. 6 is a schematic illustration of the suppression of one embodiment of the positioning elastic arm of the present invention.
Figure 7:
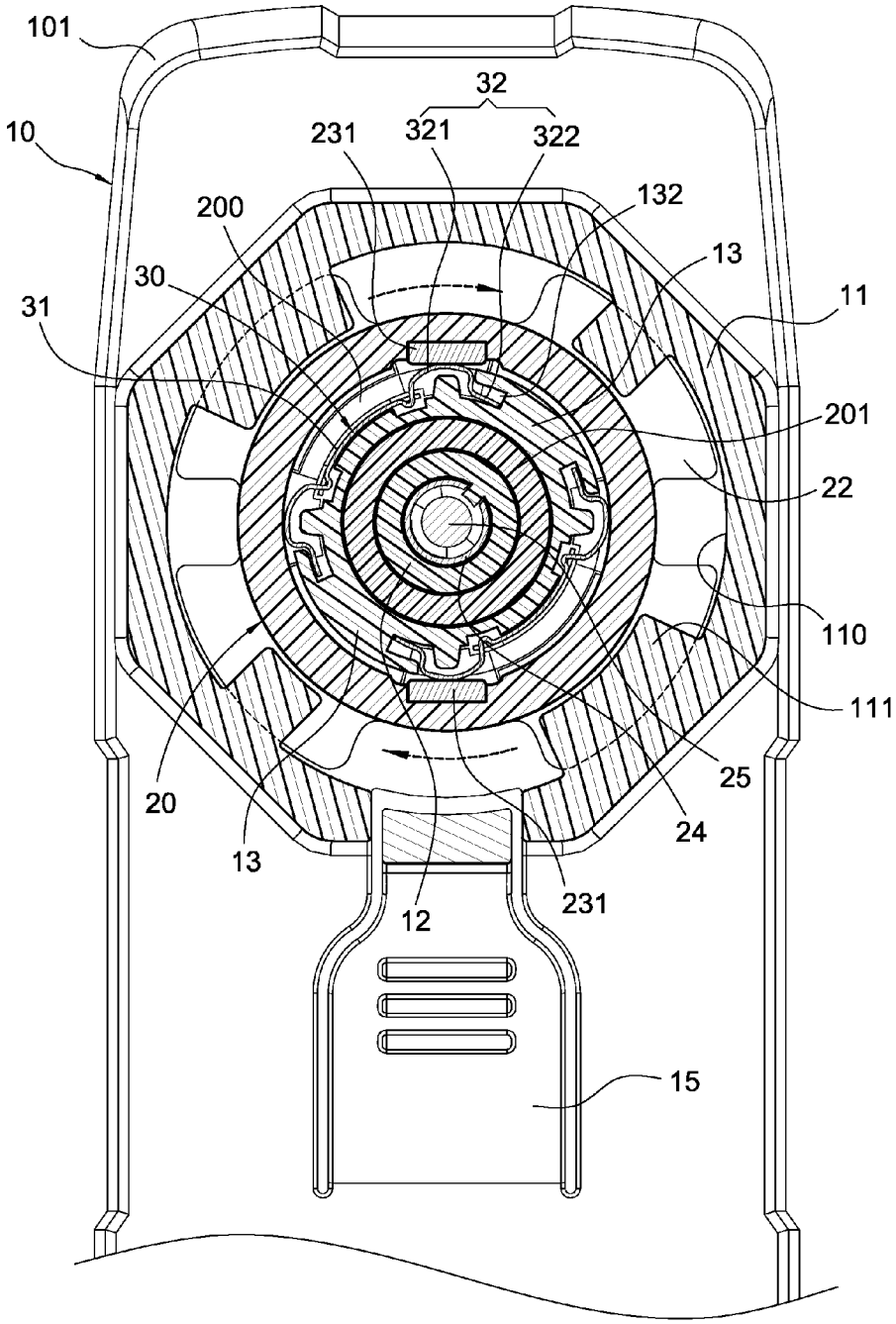
FIG. 7 is a schematic illustration of rotation of the plug of one embodiment of the present invention.
Figure 8:
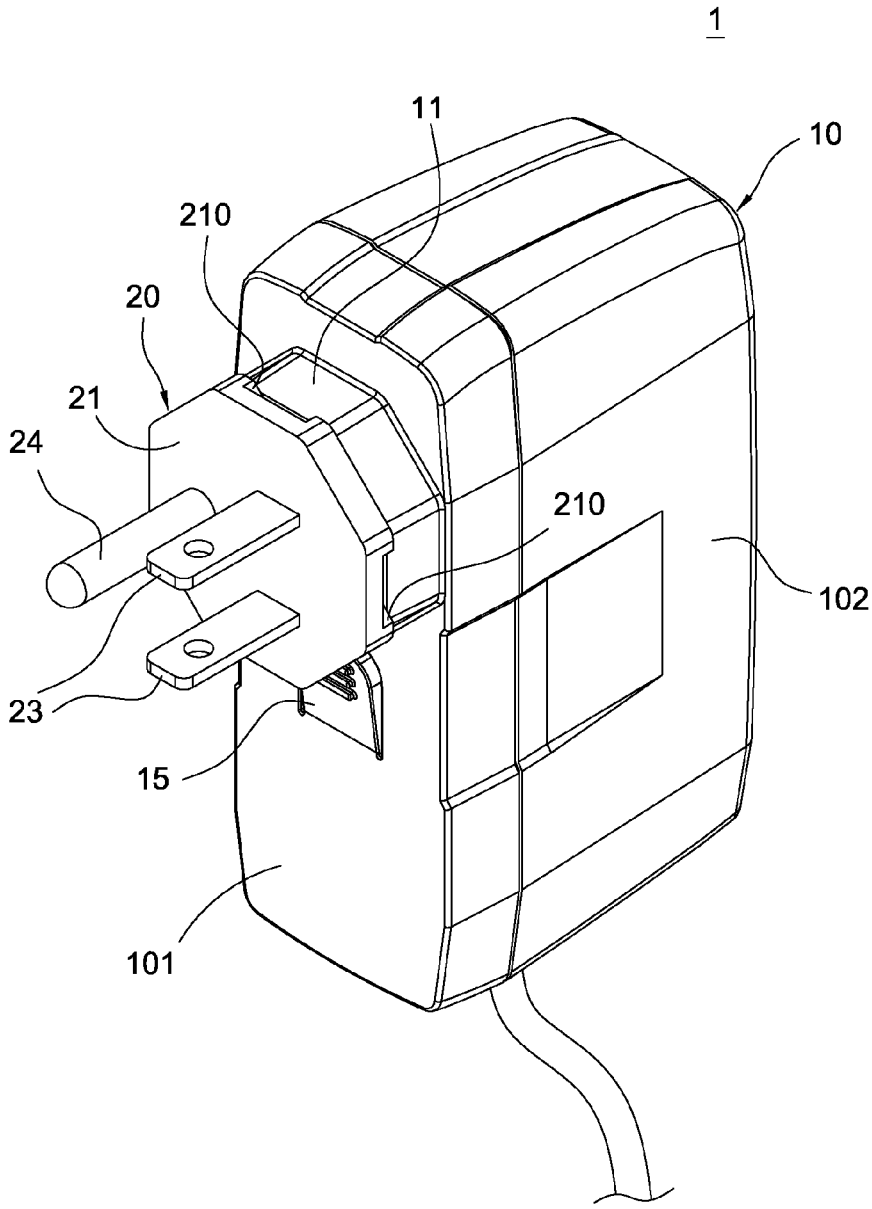
FIG. 8 is a schematic illustration of the appearance of one embodiment of the power adapter of the present invention after the rotation of the power adapter.

Please refer from FIG. 6 to FIG. 8, which are respectively a schematic illustration of the suppression of the positioning elastic arm of one embodiment of the present invention; a schematic illustration of rotation of the plug of one embodiment of the present invention; and a schematic illustration of the appearance of one embodiment of the power adapter of the present invention after the rotation of the power adapter. When changing the plug 20 of the power adapter 1, push the positioning elastic arm 15 of the insulated body 10 to separate the positioning elastic arm 15 from the notches 210 of the turntable 21 and as a result, the plug 20 may separate from the switching section 11 of the insulated body 10.

As mentioned above, when changing the direction of the plug, push the positioning elastic arm 15 and then turn the turntable 21. For example, turn the turntable 21 for 90 degree but it should not be limited to 90 degree. As a result, two conductive inserts 23 may be simultaneously turned for 90 degree, which may make the plug pins 231 of two conductive inserts 23 be connected with another conductive arm 32. Therefore, when the turntable 21 turns for 90 degree, two conductive inserts 23 of the plug 20 may also connect with two conductive terminals 30.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A power adapter having an electronic board, comprising:

an insulated body, including a switching section with a switching space connected to an outside space;

a plug including a turntable and two conductive inserts penetrating the turntable, the turntable being connected to the switching section and the two conductive inserts respectively including a plug pin; and two conductive terminals, extending to be respectively connected with the electronic board, each conductive terminal being connected to the switching section and the surface of the conductive terminals being respectively attached to the surface of the plug pins of the conductive inserts, wherein each conductive terminal includes a positioning section and two conductive arms extending horizontally from the positioning section, the positioning section is connected with the switching section directly and the surface of one of the conductive arms is attached to the surface of the plug pin of the conductive insert, and wherein the insulated body forms a installation space, the switching section includes a hollow column therein, the switching section also includes a positioning ring surrounding the hollow column, and two conductive terminals are engaged with the positioning ring.

2. The power adapter according to claim 1, wherein the positioning section and the two conductive arms extending horizontally from the positioning section are one unity, and each conductive arm extends from the first half of the positioning section.

3. The power adapter according to claim 1, wherein the insulated body further comprises a dust-proof film corresponding to the switching space, the dust-proof film is connected with the installation space, the dust-proof film is provided with an aperture corresponding to the hollow column, the plug further comprises a grounding pin penetrating the turntable and a sleeve connected with the grounding pin, the sleeve is secured to the hollow column and penetrate the aperture, and the dust-proof film is provided with a blocking piece on the side of the aperture.

4. The power adapter according to claim 1, wherein the plug includes a inserting space and an open tubular column in the inserting space, two plug pins and a grounding pin are penetrated into the inserting space, and the grounding pin is penetrated into the open tubular column.

5. The power adapter according to claim 1, wherein the plug further comprises a valve plate attached to the turntable, the valve plate includes a plurality of flanges, the adjacent flanges generate a gap in between, a fool-proof piece is provided between the turntable and the valve plate, a transferring section includes a plurality of blockings corresponding to the fool-proof piece, the flanges are respectively engaged with the blockings, and the fool-proof piece is blocked by one side of the blockings.

6. The power adapter according to claim 1, wherein the turntable includes a plurality of notches, the insulated body is provided with a positioning elastic arm, the positioning elastic arm is selectively secured to gaps and the notches.

7. The power adapter according to claim 1, further comprises two terminal pieces with the dust-proof film, the two terminal pieces are connected with the two conductive terminals to support the two conductive terminals.

8. The power adapter according to claim 1, wherein the positioning ring includes a plurality of positioning grooves outside of its wall, the positioning section of each conductive arm is engaged with the positioning groove to be connected with the switching section.

9. The power adapter according to claim 8, wherein the positioning groove respectively includes a locking aperture on both sides, each conductive terminal extends to form a locking piece on both sides, and the locking pieces are respectively secured to the locking apertures.

10. The power adapter according to claim 1, wherein the conductive arm, on its both sides, respectively includes a protruding conductive piece, whose surface is configured to be attached to the surface of the plug pin.

11. The power adapter according to claim 10, wherein the cross section of the conductive piece is essentially a U shape and includes an arc surface, the opening of the arc surface of the conductive piece faces away from the surface of the plug pin and the arc surface is attached to the plug pin.

* * * * *